US008696442B2

(12) United States Patent
Okuaki et al.

(10) Patent No.: US 8,696,442 B2
(45) Date of Patent: Apr. 15, 2014

(54) GAME SYSTEM

(75) Inventors: Masato Okuaki, Minato-ku (JP); Hiroto Nakamoto, Minato-ku (JP); Ryu Sasaki, Minato-ku (JP)

(73) Assignee: Konami Digital Entertainment Co., Ltd., Minato-Ku, Tokyo (JP)

( * ) Notice: Subject to any disclaimer, the term of this patent is extended or adjusted under 35 U.S.C. 154(b) by 0 days.

(21) Appl. No.: 13/607,400

(22) Filed: Sep. 7, 2012

(65) Prior Publication Data

US 2013/0072287 A1 Mar. 21, 2013

(30) Foreign Application Priority Data

Sep. 20, 2011 (JP) ..... 2011-205192

(51) Int. Cl.
*G07F 17/32* (2006.01)

(52) U.S. Cl.
USPC ..... 463/23; 463/7; 463/31; 463/42

(58) Field of Classification Search
USPC ..... 463/42, 7, 23, 31
See application file for complete search history.

(56) References Cited

U.S. PATENT DOCUMENTS 4,657,247 A * 4/1987 Okada ..... 463/23
6,695,697 B1 2/2004 Okada
2005/0113164 A1 5/2005 Buecheler et al.
2005/0170890 A1 8/2005 Rowe et al.
2007/0082729 A1* 4/2007 Letovsky ..... 463/23
2008/0266250 A1* 10/2008 Jacob ..... 345/156
2009/0118002 A1 5/2009 Lyons et al.

FOREIGN PATENT DOCUMENTS

JP 2001-079140 A 3/2001
JP 2007-215778 A 8/2007
JP 2009-131299 A 6/2009
WO 2007/044175 A2 4/2007

OTHER PUBLICATIONS

AU Patent Examination Report No. 1—Date of Issue Aug. 16, 2013.
Japanese Office Action with English Translation—Issued Nov. 19, 2013.

* cited by examiner

*Primary Examiner* — Omkar Deodhar
(74) *Attorney, Agent, or Firm* — Howard & Howard Attorneys PLLC

(57) ABSTRACT

In a game system which is provided with a monitor which displays a screen according to progress of a game, a touch panel which is operated by a player according to the progress of a game, a storage device which stores operation history data of the player who operates the touch panel, and a control unit, the control unit determines an attribute of the player based on the operation history data and controls setting of a game based on the determined attribute.

13 Claims, 10 Drawing Sheets

FIG. 6

ATTRIBUTE DATA 71

FACE RECOGNITION DISCRIMINATION DATA

| AGE GROUP | |
|---|---|
| ~15 | CHILDREN |
| 16~59 | MIDDLE |
| 60~ | ELDERLY |

| SEX |
|---|
| MALE |
| FIMALE |

| FACIAL EXPRESSION |
|---|
| HAPPY |
| SAD |
| ANGRY |
| SERIOUS |
| AMAZED |

FIG. 7

63

| OPERATION HISTORY DATA | |
|---|---|
| THE NUMBER OF TIMES OF ENTERING THE CHECKER | 50 |
| A TOTAL OF PLAY TIME | 7.5h |
| AN AVERAGE MEDAL INSERTION INTERVAL | 10s |
| THE NUMBER OF TIMES OF WINNING A JACKPOT | 0 |
| A RATIO OF THE NUMBER OF USED DIGITAL MEDAL | 30% |
| A SELECTION RATIO OF A RENDERING EFFECT A | 70% |
| A SELECTION RATIO OF A RENDERING EFFECT B | 20% |
| A SELECTION RATIO OF A RENDERING EFFECT C | 10% |
| MEDAL INSERTION TIMING | +1s |
| ⋮ | ⋮ |

FIG. 8

ATTRIBUTE DATA

72

| PROFICIENCY DETERMINATION DATA | BEGINNER | NORMAL | ADVANCED |
|---|---|---|---|
| THE NUMBER OF TIMES OF ENTERING THE CHECKER | LESS THAN 101 | 101～499 | MORE THAN 499 |
| A TOTAL OF PLAY TIME | LESS THAN 11h | 11～29h | MORE THAN 29h |
| AN AVERAGE MEDAL INSERTION INTERVAL | MORE THAN 9s | 3～9s | LESS THAN 3s |

FIG. 9

ATTRIBUTE DATA

73

| HABIT DETERMINATION DATA | FAST | LATE | JUST TIMING |
|---|---|---|---|
| MEDAL INSERTION TIMING | LESS THAN −1s | MORE THAN +1s | −1s～+1s |

FIG. 10

ATTRIBUTE DATA

74

| PREFERENCE DETERMINATION DATA | DIGITAL | ANALOG |
|---|---|---|
| A RATIO OF THE NUMBER OF USED DIGITAL MEDAL | 50% OR OVER | LESS THAN 50% |

FIG. 11

ATTRIBUTE DATA

75

| PREFERENCE DETERMINATION DATA | |
|---|---|
| A SELECTION RATIO OF A RENDERING EFFECT A : 50% OR OVER | JAPANESE |
| A SELECTION RATIO OF A RENDERING EFFECT B : 50% OR OVER | PRETTY |
| A SELECTION RATIO OF A RENDERING EFFECT C : 50% OR OVER | FUTURISTIC |

FIG. 12

ATTRIBUTE DATA

76

| FACE RECOGNITION DETERMINATION DATA | | PREDICTIVE PROFICIENCY |
|---|---|---|
| ～15 | CHILDREN | BEGINNER |
| 16～59 | MIDDLE | NORMAL |
| 60～ | ELDERLY | ADVANCED |

GAME SYSTEM

CROSS-REFERENCE TO RELATED APPLICATIONS

The present application claims the benefit of patent application number 2011-205192, filed in Japan on Sep. 20, 2011, the subject matter of which is hereby incorporated herein by reference.

TECHNICAL FIELD

The present invention relates to a game system that controls game setting based on a determination result of a player's attribute.

BACKGROUND ART

A variety of game machines in which a game progresses in response to a player's operation have been known (for example, see Patent Literature 1). In a medal game machine, a game progresses by a simple operation of inserting a medal, and so age groups of players who play a game range from children to the elderly. However, contents of games are diversified, and so, for example, a medal game machine that requires a player to perform a complicated operation is also present.

Patent Literature 1: JP-A-2007-215778.

SUMMARY OF INVENTION

Technical Problem

Players differ in their proficiency or preference on a game. For example, children and the elderly are mostly beginners, and do not prefer a complicated operation. When game settings such as an operation and a rendering effect are fixed to one, both beginners and advanced players may not be satisfied with a game.

Thus, the present invention aims to provide a game system which is capable of controlling game settings based on a player's operation history.

Solution to Problem

The game system of the present invention is a game system comprising: a game executing device which executes a predetermined game; a display device which displays a screen according to progress of a game; an operating device which is operated by a player according to the progress of a game; an operation history storage device which stores operation history data of the player who operates the operating device; an attribute determining device which determines an attribute of the player based on the operation history data; and a game setting control device which controls setting of a game executed by the game executing device based on the attribute determined by the attribute determining device.

According to the game system of the invention, the attribute of the player is determined based on operation history data of the player, and setting of a game is controlled based on the attribute. Thus, an operation tendency can be read from the player's operation history data and then reflected in a game environment or a rendering effect. A game environment can be diversified, and various players from children to the elderly can continuously enjoy a game.

As one aspect of the game system of the present invention, further comprising: an imaging device which images the player's face; and a discrimination data acquiring device which acquires discrimination data including an age group of the player discriminated from a face image of the player imaged by the imaging device; wherein the attribute determining device determines the attribute of the player based on the discrimination data and the operation history data. According to this, discrimination data which is an external feature of a player is acquired from the player's face image. The player's attribute is determined based on the discrimination data and the operation history data in which the player plays a game, and game setting is controlled based on the attribute. As a result, when children or the elderly plays a game, the player can be discriminated based on the face image, and an operation tendency can be read from the player's operation history data and can be reflected in a game environment or a rendering effect. A game environment can be diversified, and players from children to the elderly can continuously enjoy a game. Further, reliability of the discrimination data can be covered by the operation history data, and further appropriate control can be performed.

As one aspect of the game system of the present invention, the game setting control device controls a rendering effect of a game executed by the game executing device based on the attribute. According to this, a rendering effect of a game can be diversified according to the player's attribute determined based on the discrimination data and the operation history data. In this aspect, the game setting control device controls a rendering effect of a screen displayed on the display device.

As one aspect of the game machine of the present invention, the discrimination data further includes the player's sex and facial expression. According to this, the attribute to be given to the player increases, and control of game setting can be further diversified. Further, the operation history data further includes times of choice which are selected by the player in a game executed by the game executing device.

As one aspect of the game machine of the present invention, the attribute determining device determines the attribute with reference to attribute data in which the discrimination data or the operation history data is associated with the attribute. According to this, the attribute is determined based on the attribute data. By appropriately setting the attribute data, game setting control can be further diversified.

As one aspect of the game machine of the present invention, the attribute determining device further includes a first proficiency determining device which determines the player's game proficiency based on the discrimination data and a second proficiency determining device which determines the player's game proficiency based on the operation history data. According to this, the player's game proficiency may be determined based on either of the discrimination data and the operation history data as the attribute. In this aspect, when determination results of the first and second proficiency determining devices are the same proficiency, the attribute determining device determines the determination result as the attribute. When determination results based on the discrimination data and the operation history data are the same as each other, the determination result is determined as the player's game proficiency. Further, reliability of the discrimination data can be covered by the operation history data, and control can be performed according to the player's feature. Further, when determination results of the first and second proficiency determining devices are different proficiencies, the attribute determining device determines proficiency positioned between game proficiency determined by the first proficiency determining device and game proficiency determined by the second proficiency determining device as the attribute. According to this, when determination results are different from each other, game proficiencies determined by the determining devices may be set as an upper limit and a lower limit, and proficiency between the upper limit and the lower limit may be determined as the attribute, so that determination can be made in terms of the discrimination data, and control can be performed according to the player's feature.

As the aspect that the game proficiency of the player is determined, the game setting control device adjusts a game difficulty level based on the proficiency determined as the attribute. According to this, by changing a difficulty level setting of a game according to the player's proficiency, a game can be provided according to the player's level. Further, the game setting control device adjusts an operation difficulty level of the operating device based on the proficiency determined as the attribute. According to this, regarding operability of game, a more complicated operation setting may be allowed to an advanced player, and a simple operation setting may be allowed to a beginner. In this aspect, the operating device includes a touch panel superimposed on the display device, and the operation difficulty level is adjusted by changing a screen displayed on the display device.

As one aspect of the game machine of the present invention, comprising: a server; and a game machine which is connected to perform communication with the server via a network and includes the operating device; wherein the server includes the operation history storage device, and the game machine includes an operation history transmitting and receiving device which transmits/receives the player's operation history to/from the server, the game executing device, the display device, the attribute determining device, and the game setting control device. According to this, the player's operation history data may be managed by the server, and each game machine may perform control based on the operation history data.

Advantageous Effects of Invention

As described above, in the game system of the invention, the attribute of the player is determined based on operation history data of the player, and setting of a game is controlled based on the attribute. Thus, an operation tendency can be read from the player's operation history data and then reflected in a game environment or a rendering effect. A game environment can be diversified, and various players from children to the elderly can continuously enjoy a game.

BRIEF DESCRIPTION OF DRAWINGS

FIG. 6 is a diagram illustrating an example of face recognition discrimination data which is a part of attribute data.

FIG. 7 is a diagram illustrating an example of operation history data.

FIG. 8 is a diagram illustrating an example of history determination data which is a part of attribute data.

FIG. 9 is a diagram illustrating an example of history determination data which is a part of attribute data.

FIG. 10 is a diagram illustrating an example of history determination data which is a part of attribute data.

FIG. 11 is a diagram illustrating an example of history determination data which is a part of attribute data.

FIG. 12 is a diagram illustrating an example of face recognition determination data which is a part of attribute data.

DESCRIPTION OF EMBODIMENTS

Figure 1:
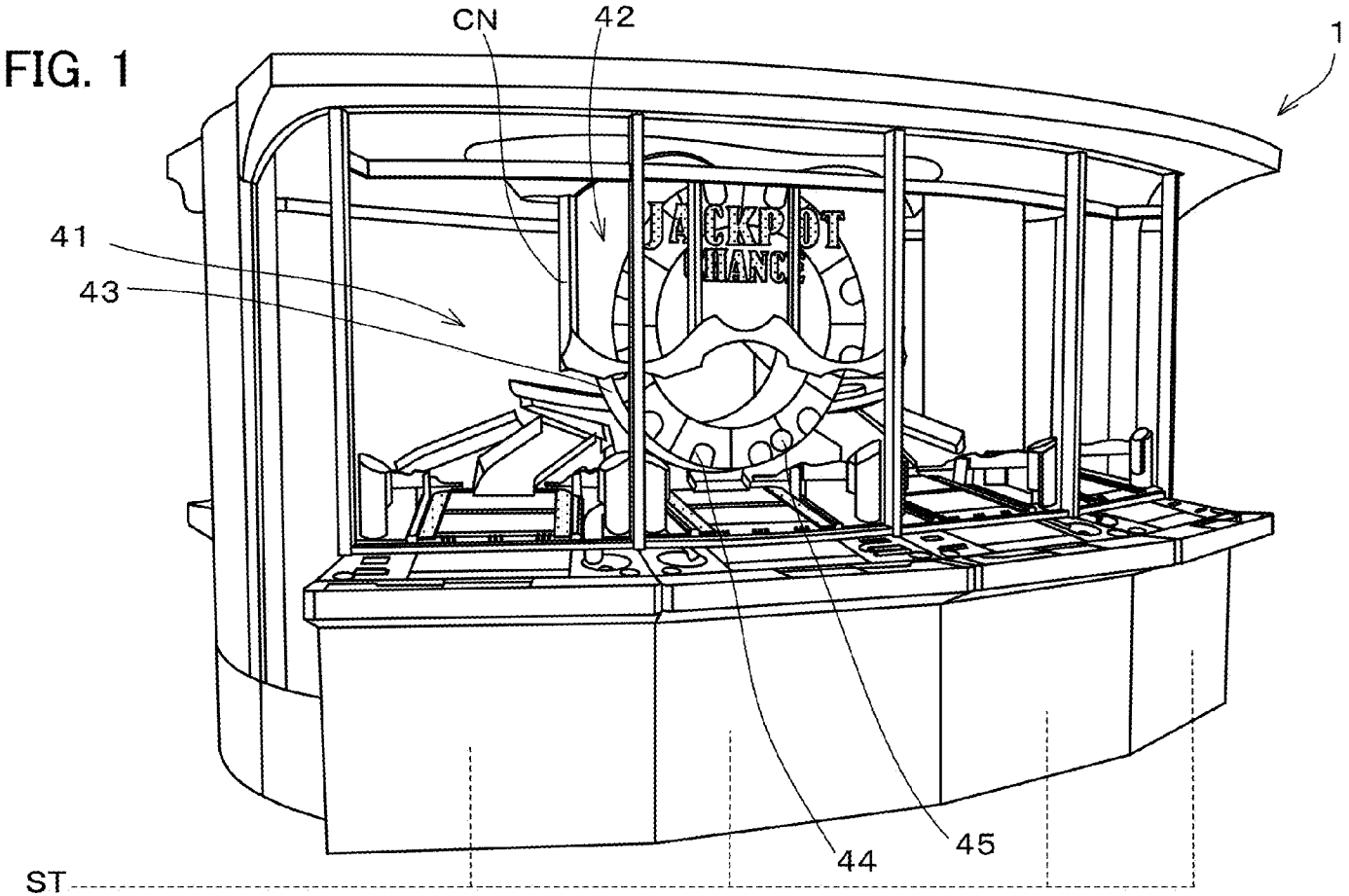
FIG. 1 is an overall view of a game machine that configures a game system according to one aspect of the present invention.

FIG. 1 is an overall view of a game machine that configures a game system according to one aspect of the present invention. A game machine 1 is a so-called medal game machine that uses a medal M as a game medium. The game machine 1 includes a center unit CN and a plurality of station units ST. The center unit CN is arranged at the center of the game machine 1, and executes a bonus game corresponding to a game result of the station unit ST. The station unit ST is arranged around the center unit CN. For example, eight station units ST are arranged such that four station units ST and four station units ST are arranged at both sides, respectively with the center unit CN interposed therebetween. The station unit ST executes a so-called pusher game using a medal and a digital lottery game corresponding to a game result of the pusher game.

Figure 2:
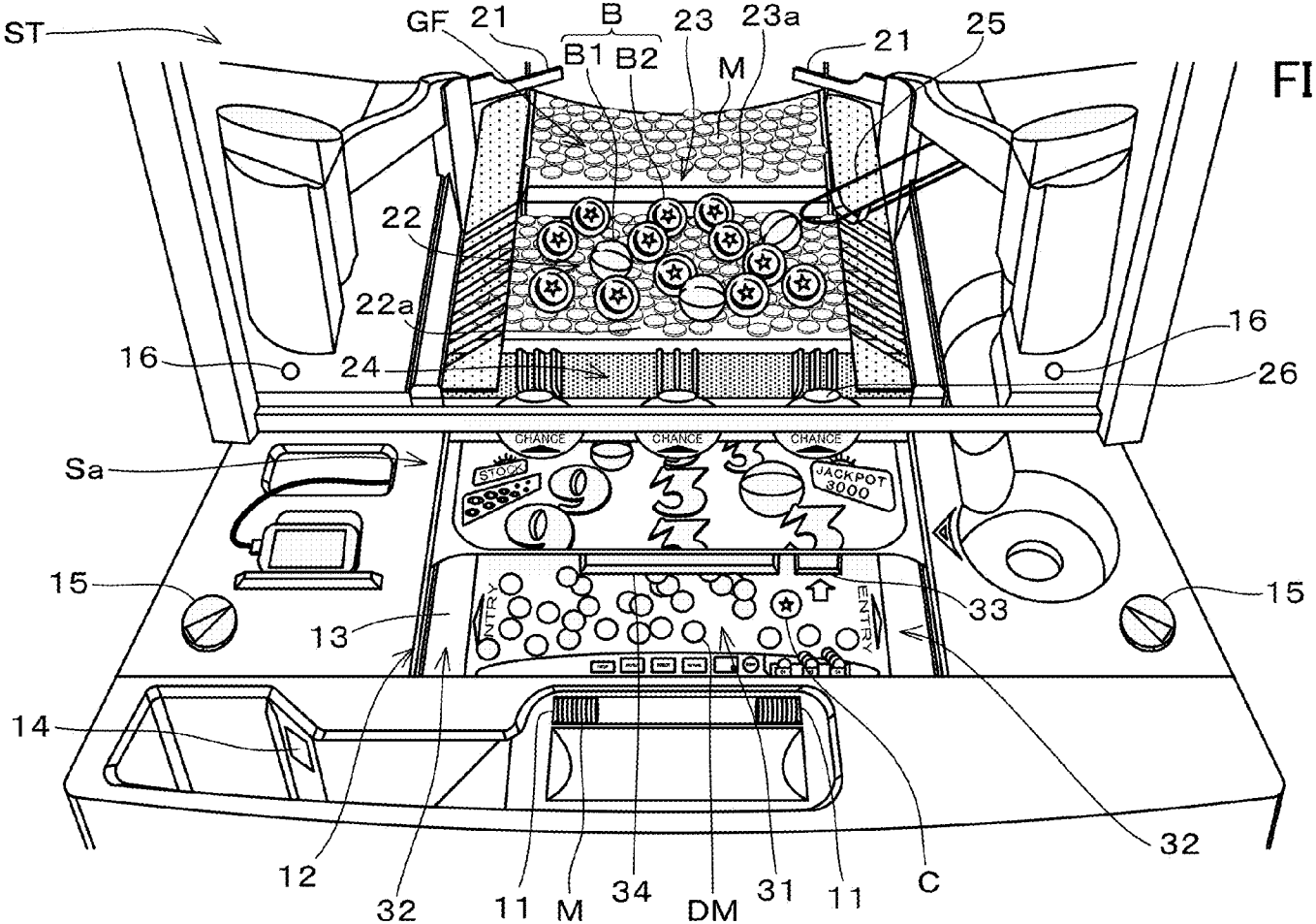
FIG. 2 is a perspective view of a station unit.

FIG. 2 is a perspective view of the station unit ST. The station unit ST includes a game field GF which is configured with a table 22 and a pusher table 23, and a pusher game using the game field GF is executed in the station unit ST. The station unit ST is provided with a medal insertion slot 11 through which the medal M is inserted into the game field GF, a monitor 12 functioning as a display unit, a transparent touch panel 13 superimposed on the surface of the monitor 12 functioning as an operating device, a medal dispensing opening 14 functioning dispensing unit that dispenses the medal M according to a result of a game executed by each station unit ST or the center unit CN, a rail operating portion 15 which will be described later, and a camera 16 functioning as an imaging device. Two medal insertion slots 11 are disposed in each station unit ST, and two players can simultaneously play through a single station unit ST.

A game screen Sa is displayed on the monitor 12. In FIG. 2, a slot game is displayed on an upper portion of the monitor 12, and an operating unit 31 that operates a digital medal DM and a chip C is displayed on a lower portion of the monitor 12. A digital slot game refers to a digital lottery game which a control unit 61, which will be described later, executes according to a game result of the game field GF. The operating unit 31 is provided with a digital medal insertion slot 32 into which the digital medal DM is inserted, a chip insertion slot 33 into which the chip C is inserted, and a digital medal dispensing opening 34. As the digital medal DM is guided to the digital medal insertion slot 32 by a touch operation, the actual medal M is inserted into the game field GF through the medal supply rail 21 which will be described later. One digital medal DM is equivalent to one actual medal M, however, for example, one digital medal DM may be set to be equivalent to three medals M.

Besides, a digital lottery game different from that in FIG. 2, a rendering effect at the time of winning, or the like is appropriately displayed on the monitor 12 depending on a game result of each station unit ST or the center unit CN. Through the touch panel 13, a touch operation associated with an image such as the digital medal DM displayed on the monitor 12 or an operation button of the digital lottery game can be made. The actual medal M is dispensed through the medal dispensing opening 14. The station unit ST may dispense the digital medal DM instead of dispensing the actual medal through the medal dispensing opening 14. In this case, an image of the digital medal DM dispensed through the digital medal dispensing opening 34 or the number of acquired medals is displayed. The camera 16 images a player's face. The camera 16 also functions as a sensor that detects whether or not a player exists and images the player's face when the player exists. A timing at which the camera 16 images is set appropriately.

Figure 4:
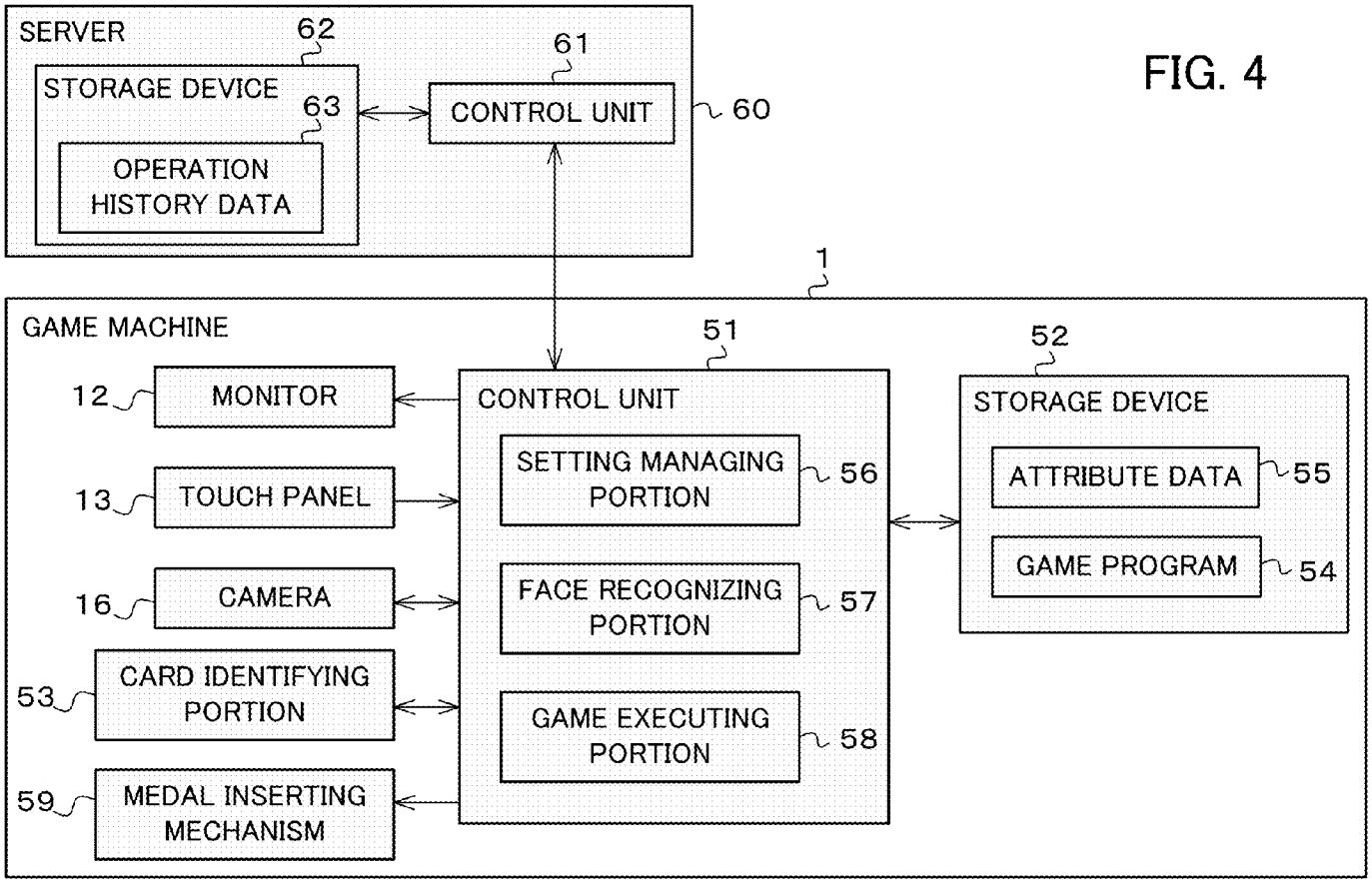
FIG. 4 is a functional block diagram illustrating a configuration of a control system of a game machine.

The station unit ST is provided with the medal supply rail 21 along which the medal M is supplied to the game field GF, the table 22 on which the medal M and a ball B are placed, the pusher table 23 that reciprocates over the table 22, a falling portion 24 that is positioned on a front end of the table 22 onto which the medal M and the ball B fall, a ball supply rail 25 along which the ball B is supplied to the table 22, and a checker 26 that detects the medal M. The medal supply rail 21 causes the medal M to be supplied to the pusher table 23 when the medal M is inserted into the medal insertion slot 11 or when an insertion operation of the digital medal DM is made by the touch panel 13. The medal supply rail 21 is connected with the medal inserting mechanism 59 (FIG. 4). The medal inserting mechanism 59 is provided with a medal storage portion that stores the medal M and an introducing portion that repeatedly introduces the medal M from the medal storage portion to the medal supply rail 21 one by one. The medal inserting mechanism 59 introduces the medal M stored in the medal storage portion from the introducing portion to the medal supply rail 21 based on a detection result of a sensor that detects the medal M inserted through the medal insertion slot 11 or the player's insertion operation of the digital medal DM by the operating unit 31. The medal inserting mechanism 59 may be configured using various known techniques. Furthermore, as the rail operating portion 15 is operated, an insertion direction of the medal M of the medal supply rail 21 changes.

The pusher table 23 reciprocates in a front-back direction by a driving mechanism (not illustrated). The medal M and the ball B pushed out by the pusher table 23 fall onto the falling portion 24. When the ball B falls onto the falling portion 24, a ball detecting portion (not illustrated) detects the ball B. When seven balls B are detected by the ball detecting portion, a first roulette game is executed as a first digital lottery game. Even though not illustrated in the drawings, the first roulette game is displayed on the monitor 12. The ball supply rail 25 supplies the ball B to the table 22 according to the game result of each station unit ST or the center unit CN. The checker 26 is disposed at the position adjacent to the falling portion 24. The slot game displayed on the monitor 12 illustrated in FIG. 2 is executed as a second digital lottery game based on detection of the medal M by the checker 26. The ball detecting portion and the checker 26 may be configured using a well-known technique such as a photoelectric sensor.

Next, the move of the medal M in the game field GF will be briefly described. When the player inserts the medal M into the medal insertion slot 11, the medal M is introduced from the medal inserting mechanism 59 to the medal supply rail 21 based on the detection result of the sensor that detects the medal M. Alternatively, when the player operates the operating unit 31 to insert the digital medal DM into the digital medal insertion slot 32, the medal M is introduced from the medal inserting mechanism 59 to the medal supply rail 21. The medal M is supplied to a medal placing surface 23*a* of the pusher table 23 through the medal supply rail 21. A group of medals on the medal placing surface 23*a* is pushed out by reciprocation of the pusher table 23, so that some medals of a group of medals are moved onto a medal placing surface 22*a* of the table 22. The balls B are placed on a group of medals on the medal placing surface 22*a*. A group of medals is pushed out by reciprocation of the pusher table 23, and so the balls B move with the movement of a group of medals. The medal M fallen onto the falling portion 24 is dispensed from the medal dispensing opening 14. Alternatively, the digital medal DM is dispensed from the digital medal dispensing opening 34. A game process of the slot game illustrated in FIG. 2 is executed based on the detection result of the medal M by the checker 26. An orb ball B1 and a chip ball B2 are provided as the ball B placed on the table 22. Here, when seven orb balls B1 fall onto the falling portion 24, the first roulette game is executed as the first digital lottery game. The chip ball B2 is collectable as the chip C. A process corresponding to the type of the fallen ball B is executed.

Figure 3:
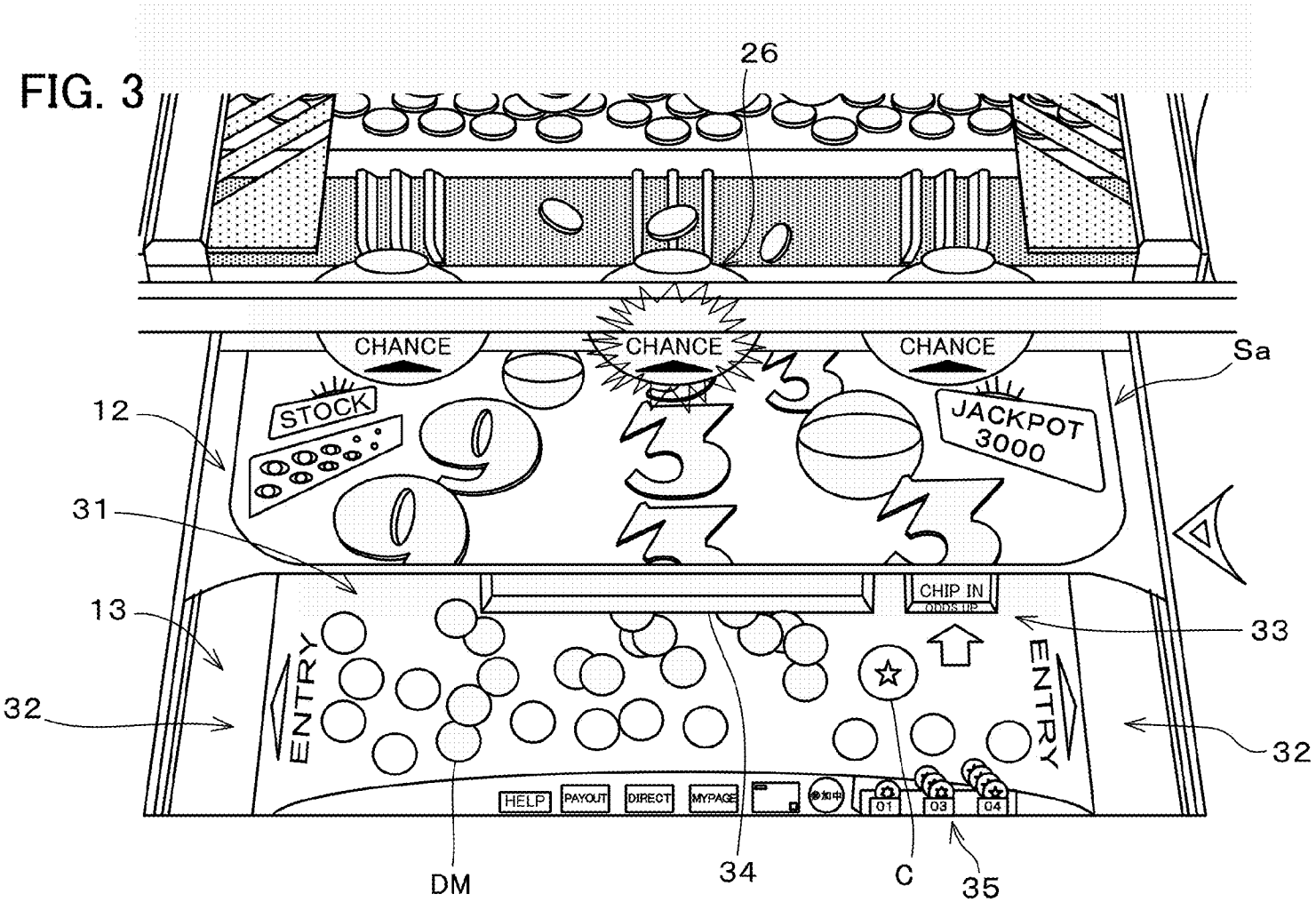
FIG. 3 is an enlarged view of a monitor.

The chip ball B2 fallen onto the falling portion 24 is detected by the ball detecting portion (not illustrated). The player acquires the chip C based on the detection result of the chip ball B2 by the ball detecting portion. The player acquires one chip C when one chip ball B2 falls. Two or more types of chip balls B2 may be provided, and the type of acquirable chip C or the number of acquirable chips C may differ according to the type of chip ball B2. Alternatively, the chip C may be acquired depending on the game result of each station unit ST or the center unit CN. FIG. 3 is an enlarged view of the monitor 12. When the player inserts the chip C displayed on the monitor 12 into the chip insertion slot 33 by a touch operation, payout of the digital lottery game executed based on the detection result of the checker 26 becomes higher payout during a predetermined time period. In FIG. 3, the slot game is executed as the digital lottery game. For example, if thirty medals are paid out at a normal time, 100 medals are paid out when the chip C is used. When the chip C is used, a rendering effect of the slot game may change. Further, when the chip C is used, a winning probability of the digital lottery game or the payout may be set to be higher than a normal time. Further, one chip C1 may be exchanged with a predetermined number of medals, for example, 10 medals M. The player may collect the chip C, the possessed chip C is displayed on a possessed chip display portion 35. Two or more types of chips C may be provided. In this case, the number of possessed chips may be displayed on the possessed chip display portion 35 for each type of chip C.

When the number of orb balls B1 fallen onto the falling portion 24 reaches seven, each station unit ST executes the first roulette game as the first digital lottery game. The center unit CN executes a jackpot game when a "jackpot chance" is won in the first roulette game executed by each station unit ST. Referring back to FIG. 1, the center unit CN will be described. The center unit CN is provided with a lottery mechanism 41 and a monitor 42. The lottery mechanism 41 is provided with a rotating plate 43 that rotates, a plurality of lottery holes 44 disposed in the rotating plate 43, and a lottery ball 45 that enters the lottery hole 44. The lottery mechanism 41 executes a second roulette game as a jackpot game. When the lottery ball 45 enters any one of the lottery holes 44, the medals M which are equal in number to the number associated with the corresponding lottery hole 44 are dispensed to the player as payout. When payout of the medal M is paid to the player who won the slot game or the first roulette game executed by each station unit ST, the medals M which correspond in number to the payout are supplied from the medal supply opening to the game field GF. When the jackpot game is executed, a predetermined rendering effect is displayed on the monitor 42. Even when the jackpot game is not displayed, a predetermined rendering effect may be displayed to boost a game.

FIG. 4 is a functional block diagram illustrating a configuration of a control system of the game machine 1. The game machine 1 includes a control unit 51 that executes various control processes to execute a predetermined game and a storage device 52. The control unit 51 is connected with the monitor 12, the touch panel 13, the camera 16, a card identifying portion 53, and the medal inserting mechanism 59. The control unit 51 transmits or receives a signal or data necessary for the progress of a game. The card identifying portion 53 identifies a card by reading a player's ID (which may be hereinafter referred to as a "player ID") recorded on a card inserted through a card insertion slot (not illustrated) disposed in the game machine 1. In addition, the control unit 51 is connected to various sensors, mechanisms, and members necessary to execute or set a game, and controls transmission and reception of a signal or data or an operation. Examples of the storage device 52 include a magnetic storage medium, an optical storage medium, and a non-volatile storage medium such as an electrically erasable programmable read-only memory (EEPROM). The storage device 52 stores a game program 56 for executing a game through the game machine 1 and attribute data 55 for determining attributes of a player. In addition, the storage device 52 stores a variety of data necessary to execute a game.

As the control unit 51 reads and executes the game program 54 stored in the storage device 52, a setting managing portion 56, a face recognizing portion 57, and a game executing portion 58 are implemented in the control unit 51 as logical devices. The setting managing portion 56 manages game setting associated with a player's attribute which will be described later and controls game setting according to an attribute. The face recognizing portion 57 determines the player's sex, age group, facial expression, or the like based on a face image obtained by a camera 16 using a face recognition algorithm. A face recognition system is applied to the face recognizing portion 57. A variety of well-known techniques may be used as the face recognition system including the face recognition algorithm. The game executing portion 58 executes various processes necessary for the progress of a game. The game executing portion 58 functions as a game executing device.

The game machine 1 is connected to perform communication with a server 60 through a network. The server 60 is installed by an operator of the game machine 1, and provides various services using a network to the game machine 1 or the player of the game machine 1. The server 60 is provided with a control unit 61 and a storage device 62 as an operation history storage device. The control unit 61 is configured as a computer unit in which an MPU is combined with peripheral devices necessary to operate the MPU such as a RAM and a ROM. The control unit 61 executes updating of a game program or data. The control unit 61 performs authentication on the player of the game machine 1 using a player ID and a password, and then causes operation history data 63, which includes the player's play history, save data, and the like, to be stored in the storage device 62 of the server 60. Examples of the storage device 62 include a magnetic storage medium, an optical storage medium, and a non-volatile storage medium such as an EEPROM. Each of the game machine 1 and the server 60 has a unique address identifying itself on a network, and a communication partner is specified using the address in communication between the game machine 1 and the server 60.

Figure 5:
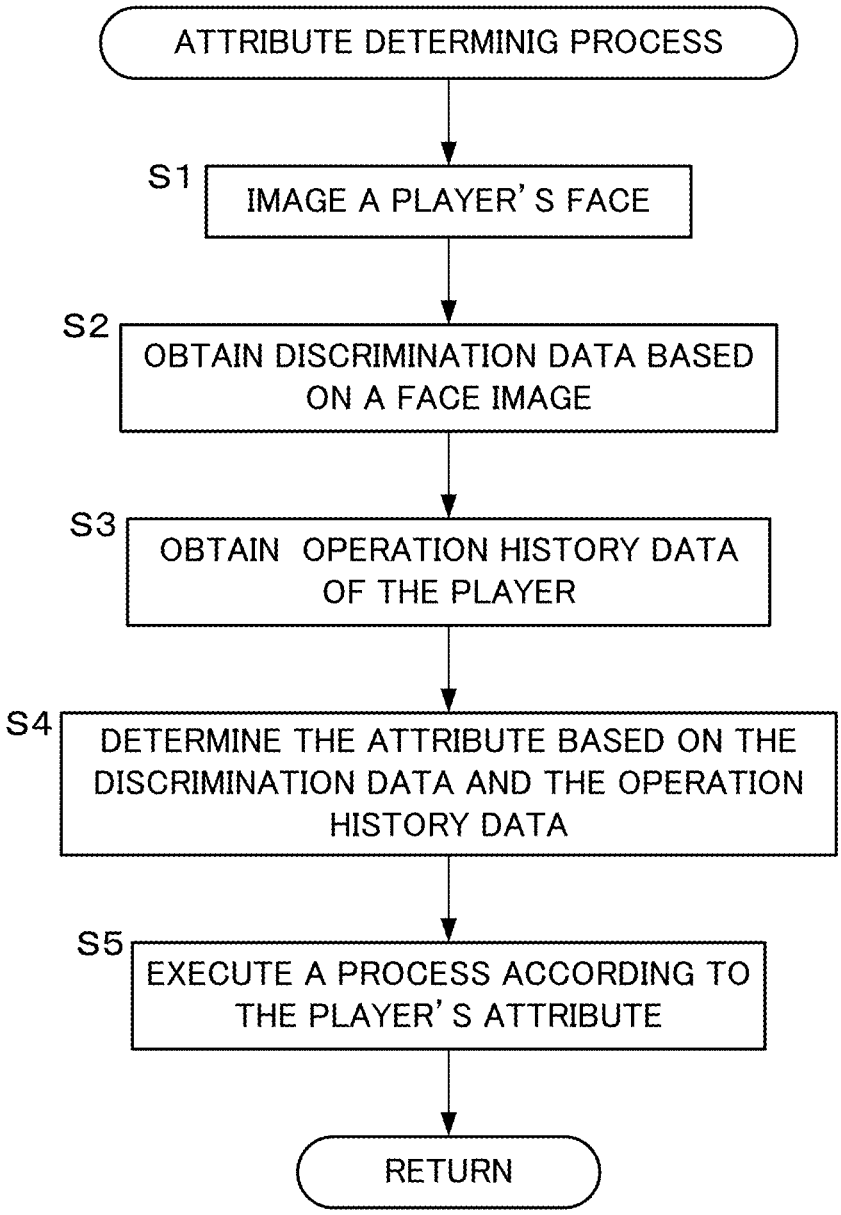
FIG. 5 is a flowchart illustrating an attribute determining process routine executed by a control unit.

FIG. 5 is a flowchart illustrating an attribute determining process routine executed by the control unit 51. In the flowchart of FIG. 5, a basic flow of the process will be described. First, in step S1, the control unit 51 images the player's face. When the presence of the player is recognized through an automatic recognition function by the camera 16, the player's face is imaged. Subsequently, in step S2, the control unit 51 acquires discrimination data based on a face image obtained by imaging. The discrimination data is data obtained by the discrimination result of the face recognition system executed by the face recognizing portion 57. A variety of well-known techniques may be used as the face recognition system. For example, the discrimination result is obtained such that data of a comparison target is extracted by analyzing the face image, and then compared with a comparative face image database. FIG. 6 is a diagram illustrating an example of face recognition discrimination data 71 which is a part of attribute data 55. The face recognition discrimination data 71 is data used to discriminate the player's attribute based on the discrimination result obtained by the discrimination of the face image by the face recognition system. Discrimination of an item of the face recognition discrimination data 71 is associated with the discrimination result obtained by the face authentication system. Thus, an age group, a sex, and a facial expression of the player are discriminated using the face recognition system. For example, the discrimination data is obtained like "age group: elderly, sex: male, facial expression: happy." Each item of FIG. 6 is exemplary, and may be appropriately changed according to the accuracy of the used face recognition system.

In step S3, the control unit 51 acquires the operation history data 63 of the player. The operation history data 63 recorded in the storage device 62 of the server 60 is acquired. History necessary to determine an attribute such as operation content or a score when the player plays with the game machine 1 is recorded in the operation history data 63. The game machine 1 is controlled to transmit the operation history data 63 in which current play history is recorded to the server 60 when playing a game stops. The server 60 manages the operation history data 63 in association with a player ID. In case of a stand-alone type game machine which is not connected with the server 60, operation history data accumulated in the game machine 1 by current play may be used. FIG. 7 is a diagram illustrating an example of the operation history data 63. For example, data related to game play such as the number of times of entering the checker, a total of play time, an average medal insertion interval, the number of times of winning a jackpot is recorded as the operation history data 63. An item of the operation history data 63 may be appropriately set and changed depending on a game. Next, in step S4, the control unit 51 determines the player's attribute based on the discrimination data and the operation history data 63. The attribute is determined with reference to the attribute data 55. The attribute is determined by a combination with a result discriminated from the discrimination result and the operation history data 63 obtained based on the discrimination data. The attribute such as the player's proficiency, preference, and habit is determined based on the operation history data 63.

FIGS. 8 to 11 are diagrams illustrating an example of history determination data which is a part of the attribute data 55. For example, as the history determination data, FIG. 8 illustrates proficiency determination data 72, FIG. 9 illustrates habit determination data 73, and FIGS. 10 and 11 illustrate preference determination data 74 and 75. The proficiency determination data 72 is data used to determine the player's operation determination proficiency, which will be described later, based on the operation history data 63. Content of each item may be appropriately changed. The habit determination data 73 is one in which a timing optimal to insert the medal M is set in terms of movement of the pusher table 23 as a standard, and a difference in a timing of insertion by the player is determined based on the standard. An insertion timing used as a standard is set based on a timing at which the medal insertion mechanism 59 operates to insert the medal M and an operation timing of the pusher table 23. A timing at which the medal M inserted by the player arrives at the pusher table 23 when the pusher table 23 is positioned at the most front side from the player's point of view is assumed as the insertion timing used as the standard. It is a timing at which the player most expects to acquire the medal M. When the pusher table 23 is positioned at the rear side, the medal M is stacked on the medals M already placed on the pusher table 23, and a possibility that the medal M will fall onto the table 22 is lowered. In case of a game machine of a type in which the medal insertion mechanism 59 is not disposed, and the medal M inserted by the player is directly inserted into the game field GF, the sensor that detects the medal M may be disposed at an appropriate position of the medal supply rail to detect the insertion timing. Alternatively, the insertion timing used as the standard may be determined in terms of a timing at which the sensor disposed on the medal supply rail detects the medal M and a time until the medal M arrives as the pusher table after the sensor detects the medal M.

The preference determination data 74 is data used to determine which of the digital medal DM and the medal M has been used by preference based on a ratio of each of the number of used digital medal DM and the number of used medal M. The preference determination data 75 is used to determine a tendency that the player prefers based on a selection ratio of a rendering effect selectable in the game machine 1. For example, a Japanese concept design is employed in a rendering effect A, a pretty design in which an animal, a character, or the like is drawn is employed in a rendering effect B, and a futuristic design is employed in a rendering effect C. The player's preference is determined based on a ratio at which the player selects a rendering effect. FIG. 12 is a diagram illustrating an example of a face recognition determination data 76 which is a part of the attribute data 55. Predictive proficiency which will be described later is determined based on the player's determined age group. The attribute data 55 is exemplary, and the attribute may be appropriately set and changed based on an item of the operation history data 63 and the discrimination data. A plurality of determination results such as "elderly, male, beginner, and Japanese style" are determined as the attributes based on the attribute data 55.

In step S5, the control unit 51 performs game setting control corresponding to the attribute determined in step S4. For example, control of a rendering effect such as a design change of the operating unit 31, a change of a background image, and a design change of a digital slot lottery image, a change of an operation method by the operating unit 31, or a game difficulty level is performed. In the process of step S4, the attribute is determined based on the discrimination data and the operation history data 63. However, for example, when attributes of "elderly and Japanese style" are given, control is performed such that a Japanese style design is applied to the entire rendering effect of the game machine 1. Further, a rendering effect corresponding to current facial expression may be further added based on a discrimination result of facial expression of discrimination data. For example, when facial expression is discriminated as being "happy," a flashier rendering effect may be applied when a lottery is won. Examples of the rendering effect includes a physical rendering effect by various devices using the medal M, the ball B, lighting or the like and an electronic rendering effect displayed on the monitor 12, and either of the rendering effects may be controlled. A variety of game setting controls is executed according to a combination of attributes to be given. Then, the control unit 51 ends the current process.

In the attribute determining process, the player's face is imaged (step S1), discrimination data is acquired based on the acquired face image (step S2), and the player's operation history data 63 is acquired (step S3). The attribute is determined based on the acquired discrimination data and the operation history data 63 (step S4), and a game setting control process corresponding to the attribute is performed (step S5). An external feature such as the player's age group, sex, or facial expression is determined based on the face image, and a feature in which the player plays a game may be determined based on the operation history data 63. Based on this data, a rendering effect or a difficulty level of the game machine 1 may be changed according to the player. Further, a game's property can be diversified, and each player can be provided with an optimal game environment. Further, reliability of discrimination data can be compensated by the operation history data 63, and more appropriate control can be performed.

In the above-described process, the process of step S2 functions as a discrimination data acquiring device, the process of step S4 functions as an attribute determining device, and the process of step S5 functions as a game setting control device. Further, the processes of steps S1 and S2 are executed by the face recognizing portion 57 of the control unit 51, and the processes of steps S3 to S5 are executed by the setting managing portion 56.

Figure 13:
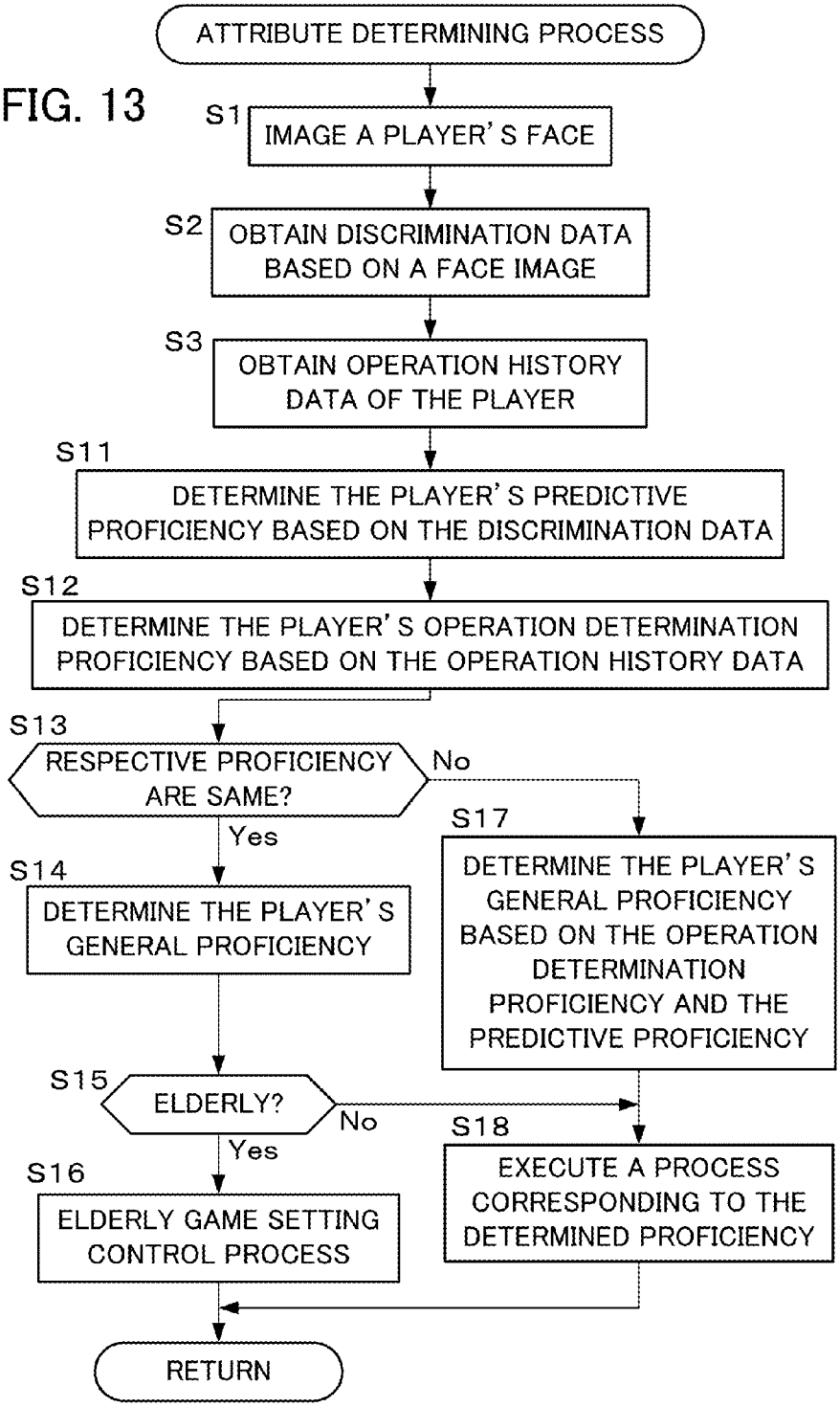
FIG. 13 is a flowchart illustrating a more concrete example of an attribute determining process.

FIG. 13 is a flowchart illustrating a further concrete example of the attribute determining process. Steps S1 to S3 are the same as in the above-described process, and thus the redundant description will not be repeated. After step S3, the control unit 51 causes the process to proceed to step S11, and determines the player's predictive proficiency based on the discrimination data. The player's predictive proficiency is determined based on the face recognition determination data 76 illustrated in FIG. 12. Players of "children" and "elderly" are determined as "beginner." Next, in step S12, the control unit 51 determines the player's operation determination proficiency based on the operation history data 63. The player's operation determination proficiency is determined based on the proficiency determination data 72 illustrated in FIG. 8. For example, when any one item has content corresponding to a beginner, the player may be determined as "beginner." Further, the player may be determined as "beginner" when a predetermined number of items have content corresponding to a beginner. The determination method based on the operation history data 63 may be appropriately set and changed. The predictive proficiency is to determine proficiency predicted from an age group discriminated by the face recognition system, and the operation determination proficiency is objective proficiency determined based on the player's operation history data 63.

In step S13, the control unit 51 determines whether or not respective proficiency determination results based on the discrimination data and the operation history data 63 are the same. When respective proficiency determination results are the same, the control unit 51 determines proficiency determined as being the same in step S14 as the player's general proficiency. Next, in step S15, the control unit 51 determines whether or not the player's attribute is "elderly." When the player's attribute is "elderly," the process proceeds to step S16. In step S16, the control unit 51 executes an elderly game setting control process, and ends the current process. In recent years, in the medal game machine, elderly players have continued to increase. For this reason, it is possible to motivate players of the elderly or the beginners to continue a game by providing a game environment in which players of the elderly or the beginners can easily play. For example, the size of the digital medal DM or text displayed on the operating unit 31 may be increased. Further, a difficulty level of a game may be lowered. For example, by appropriately adjusting the insertion timing of the medal M or increasing a winning probability of a lottery game, a game can be made easy. The insertion timing of the medal M may be adjusted by adjusting a timing at which the medal insertion mechanism 59 introduces the medal M to the medal supply rail 21 according to movement of the pusher table 23. For example, medal insertion timing may be adjusted by driving the medal insertion mechanism 59 at the insertion timing, used as the standard, which is optimal to insert the medal M. Further, a rendering effect that the elderly prefer may be automatically set. As a result, the player's age group which is hardly discriminated by the operation history data 63 can be determined based on a face image, and then a game environment for the elderly can be provided. Further, reliability of data by discrimination data can be compensated by determining the player's proficiency based on the operation history data 63.

Meanwhile, when it is determined in step S13 that respective proficiency determination results are different, the control unit 51 causes the process to proceed to step S17. In step S17, the control unit 51 determines the player's general proficiency out of the operation determination proficiency determined based on the operation history data 63 and the predictive proficiency determined based on the discrimination data. When respective proficiency determination results are different, the discrimination result based on the face image may be determined as being different from the player's actual age group or sex, or the players of the elderly or children may have a high skill Even though respective proficiencies are different, the operation determination proficiency and the predictive proficiency may be used as an upper limit and a lower limit, proficiency between the upper limit and the lower limit may be used as general proficiency, and determination may be made in terms of predictive proficiency. For example, intermediate proficiency between the operation determination proficiency and the predictive proficiency may be used as general proficiency. For example, when the operation determination proficiency is "advanced level" and the predictive proficiency is "beginner level," "normal level" may be determined as general proficiency. Further, proficiency determined based on the operation history data 63 may be determined as the player's proficiency. More reliable determination may be made based on an actual operation. It should be noted that proficiency is not limited to three levels of "beginner level," "normal level," and "advanced level," and more levels may be set. The general proficiency may be determined in terms of an attribute other than the player's proficiency.

Then, the control unit 51 causes the process to proceed to step S18. In step S18, the control unit 51 performs a process corresponding to the determined proficiency, and then ends the current process. When it is determined in step S15 that the player is not "elderly," the control unit 51 causes the process to proceed to step S18. For example, as a process corresponding to proficiency, for "advanced level", more detailed game setting may be selected, and a difficulty level may be increased. For example, a difficulty level may be increased by decreasing a winning probability of a lottery game or by increasing an operation speed at which the pusher table 23 reciprocates in the front-back direction. Further, when "beginner" is determined as proficiency in step S14, in case of "children," a rendering process for children may be executed. A character that children prefer may be displayed on a game screen, or text may be converted to be easily read. Further, various program settings may be made corresponding to the determined attribute.

In the above-described process, the control unit 51 determines the player's predictive proficiency based on the discrimination data (step S11), determines the player's operation determination proficiency based on the operation history data 63 (step S12), and then determines whether or not respective proficiencies are the same as each other (step S13). When respective proficiencies are the same as each other, the proficiency is determined as the player's general proficiency (step S14). Then, when the player is the elderly (step S15), the control unit 51 executes the elderly game setting control process (step S16). However, when it is determined in step S13 that respective proficiencies are different, the control unit 51 determines the player's general proficiency based on the discrimination data and the operation history data 63 (step S17). Then, the process corresponding to the general proficiency is executed (step S18). Thus, game setting for the elderly can be automatically set on the player determined as the elderly and the beginner. Various settings can be applied depending on the player, and game setting can be changed according to the player's general proficiency.

In the above-described process, the processes of steps S11 to 15 and S17 function as the attribute determining device, the processes of steps S16 and S18 function as the game setting control device. Particularly, the process of step S11 functions as a first proficiency determining device, and the process of step S12 functions as a second proficiency determining device. Further, the processes of steps S11 to S18 are executed by the setting managing portion 56 of the control unit 51.

The invention is not limited to the above embodiment and can be embodied in various forms. For example, in step S2, the discrimination data is acquired based on the face image, and in step S4, the attribute is determined based on the discrimination data and the operation history data 63. However, the invention is not limited to this example. For example, in step S4, the attribute may be determined based on the operation history data 63. In this case, in the attribute determining process, the processes of steps S1 and S2 are unnecessary, and in step S4, the attribute is determined based on the operation history data 63. The attribute such as the player's proficiency, preference, or habit may be determined based on the operation history data 63, and game setting control may be performed based on the attribute. Further, the present embodiment has been described in connection with the game system in which the game machine 1 is connected to perform communication with the server 60. The invention is not limited to this example. The game machine 1 may be of a stand-alone type, and the player's the operation history data 63 may be recorded in the storage device 52 of the game machine 1. Using a player ID, the operation history data 63 may be recorded in the game machine 1 for each player.

The monitor 12 on which the touch panel 13 is superimposed has been described as the display device, but the invention is not limited to this example. For example, a rendering effect in the monitor 42 of the center unit CN may be changed. Game setting may be controlled through various display devices installed in the game machine.

What is claimed is:

1. A game system comprising:

a game executing device which executes a predetermined game;

a display device which displays a screen according to progress of a game;

an operating device which is operated by a player according to the progress of a game;

an operation history storage device which stores operation history data of the player who operates the operating device;

an attribute determining device which determines an attribute of the player based on the operation history data; and a game setting control device which controls setting of a game executed by the game executing device based on the attribute determined by the attribute determining device;

an imaging device which images the player's face; and a discrimination data acquiring device which acquires discrimination data including an age group of the player discriminated from a face image of the player imaged by the imaging device; wherein the attribute determining device determines the attribute of the player based on the discrimination data and the operation history data.

2. The game system of claim 1, wherein the game setting control device controls a rendering effect of a game executed by the game executing device based on the attribute.

3. The game system of claim 2, wherein the game setting control device controls a rendering effect of a screen displayed on the display device.

4. The game system of claim 1, wherein the discrimination data further includes the player's sex and facial expression.

5. The game system of claim 1, wherein the operation history data further includes times of choice which are selected by the player in a game executed by the game executing device.

6. The game system of claim 1, wherein the attribute determining device determines the attribute with reference to attribute data in which the discrimination data or the operation history data is associated with the attribute.

7. The game system of claim 1, wherein the attribute determining device further includes a first proficiency determining device which determines the player's game proficiency based on the discrimination data and a second proficiency determining device which determines the player's game proficiency based on the operation history data.

8. The game system of claim 7, wherein when determination results of the first and second proficiency determining devices are the same proficiency, the attribute determining device determines the determination result as the attribute.

9. The game system of claim 7, wherein when determination results of the first and second proficiency determining devices are different proficiencies, the attribute determining device determines proficiency positioned between game proficiency determined by the first proficiency determining device and game proficiency determined by the second proficiency determining device as the attribute.

10. The game system of claim 8, wherein the game setting control device adjusts a game difficulty level based on the proficiency determined as the attribute.

11. The game system of claim 8, wherein the game setting control device adjusts an operation difficulty level of the operating device based on the proficiency determined as the attribute.

12. The game system of claim 11, wherein the operating device includes a touch panel superimposed on the display device, and the operation difficulty level is adjusted by changing a screen displayed on the display device.

13. The game system of claim 1, comprising:

a server; and a game machine which is connected to perform communication with the server via a network and includes the operating device; wherein the server includes the operation history storage device, and the game machine includes an operation history transmitting and receiving device which transmits/receives the player's operation history to/from the server, the game executing device, the display device, the attribute determining device, and the game setting control device.

* * * * *